US007275631B2

(12) United States Patent
Hsieh

(10) Patent No.: US 7,275,631 B2
(45) Date of Patent: Oct. 2, 2007

(54) ENGAGING/DISENGAGING FAIL-SAFE DOOR CLOSING DEVICE FOR ROLLING FIRE DOOR AND DOOR MACHINE HAVING SAME

(76) Inventor: Chung Hsien Hsieh, No. 25-1, Fen-Liao Rd., Lin-Kou Hsiang, Taipei Hsien (TW)

( * ) Notice: Subject to any disclaimer, the term of this patent is extended or adjusted under 35 U.S.C. 154(b) by 392 days.

(21) Appl. No.: 11/012,545

(22) Filed: Dec. 15, 2004

(65) Prior Publication Data

US 2006/0124250 A1 Jun. 15, 2006

(51) Int. Cl.
*E06B 9/68* (2006.01)

(52) U.S. Cl. ..... 192/226; 188/164; 160/9

(58) Field of Classification Search ..... 192/226; 160/7, 9

See application file for complete search history.

(56) References Cited

U.S. PATENT DOCUMENTS 5,245,879 A 9/1993 McKeon
5,850,865 A 12/1998 Hsieh
6,092,582 A * 7/2000 Liu ..... 160/310
6,155,324 A * 12/2000 Elliott et al. ..... 160/1
2004/0113574 A1* 6/2004 Hsieh ..... 318/275
2005/0172559 A1* 8/2005 Hsieh ..... 49/140

FOREIGN PATENT DOCUMENTS

DE 2827164 A1 * 1/1980

* cited by examiner

*Primary Examiner*—Richard M Lorence
(74) *Attorney, Agent, or Firm*—Bucknam and Archer

(57) ABSTRACT

There is disclosed an engaging/disengaging fail-safe door closing device for a rolling fire door, provided between a power device and a speed reducing device of a door machine, including an electromagnet fixed inside a housing of the door machine and disposed around the outside of a shaft of the power device; a brake device including a shaft sleeve, loosely embracing around the outside of the shaft of the power device and being capable of sliding between the shaft and the electromagnet, on one end of which, there is provided an attracted plate facing the magnet and coming off the magnet by way of the biasing force of an elastic element, while on the other end there is radially formed a brake disk; a driving plate fixed on the shaft of the power device and facing a position where the brake disk is allowed to contact; and a circuit used to control the electromagnet to be electrified to excite in order for actuating the brake when the door reaches a predetermined position, or to release the brake when the power is cut off.

11 Claims, 6 Drawing Sheets

ENGAGING/DISENGAGING FAIL-SAFE DOOR CLOSING DEVICE FOR ROLLING FIRE DOOR AND DOOR MACHINE HAVING SAME

FIELD OF THE INVENTION

The present invention is related to a fail-safe door closing device, particularly to an engaging/disengaging fail-safe door closing device for rolling fire door, which actuates the brake by electrifying an electromagnet means to excite when a door machine opens the door to a predetermined location, capable of releasing the brake and then closing the rolling door immediately in a condition of power failure.

BACKGROUND OF THE INVENTION

Accordingly, a conventional rolling door for fire protection may be exclusively classified, depending on braking mode, into two systems: one is fail-safe and the other is non-fail-safe. The rolling fire door is functioned as entrance guard for regular access, and then, based on its usage, there are advantages and disadvantages for the use of these two systems, respectively, as follows:

(1) Fail-safe mode: Brake is released immediately by a brake device to close the rolling fire door in the absence of electrical power no matter what reason therefore is. If the fire occurs in the presence of electrical power, the power is cut off by, for instance, smoke detectors, temperature sensors, and other fire detecting devices, or is mechanically cut off by fusible link devices which melt owing to high temperature in the fire in such a way that brake may be released and then the rolling door may be downwardly closed by its own weight. In this mode, the flame or escape of dense smoke may be blocked instantly when the fire occurs, if the cause for power failure is the fire indeed, whereby, a greater safety for fire prevention is the main merit. However, if the cause for this power failure is not the fire, inconvenience for users and influence on the regular access may take place, which is the main drawback in this mode.

(2) Non-fail-safe mode: The brake device is still presented in a brake-actuated state without closing the rolling fire door immediately in the absence of electrical power, no matter what reason therefor is. Only when the definite occurrence of fire is confirmed by, for instance, smoke detectors, temperature sensors, and other fire detecting devices, a current from a reserved power source, such as a capacitor, battery, and so on, is transiently supplied to the brake device for releasing the brake for a short period of time, or fusible link devices melt due to high temperature in the fire for mechanically operating the brake device to release the brake, in such a manner that the rolling fire door may be downwardly closed by its own weight. In this mode, the rolling fire door is not closed immediately in the absence of electrical power, also never resulting in confusing general users, provided that the fire is not the cause for power failure, which is the main merit. However, in case that the power failure is not induced by the fire, and in case that the fire point is further farther from the fire detecting devices or fusible link devices, it is impossible to close the rolling fire door instantly when the fire occurs. Therefore, the lack of safety for fire prevention is the main drawback in this mode.

FIG. 4 is a diagram redrawn according to U.S. Pat. No. 5,245,879, showing a typical fail-safe rolling fire door, as an example of conventional art. In this published prior patent document, there is disclosed a fire door having automatic reset in which a brake actuator may disengage the brake by the potential energy of a spring in the common condition. When electrified, the potential energy of spring may be overcome by a solenoid, moving the brake actuator and engaging the brake. When an abnormal power failure occurs, this brake actuator de-energizes the solenoid immediately, causing the brake actuator to disengage the brake under the effect of spring, in such a way that the rolling door may be downwardly closed by its own weight. Moreover, FIG. 5 shows a diagram of another fail-safe rolling fire door according to U.S. Pat. No. 5,850,865. In this published prior patent document, a brake is released automatically after the delayed time, such that the rolling door may be downwardly closed by its own weight, in an abnormal power failure condition.

In the above published patent document. The solenoid is used to operate a pair of drum brake shoes via a brake-operating pin. It will be appreciated by those skilled in the art that this mechanism is relatively complicated and thus the cost thereof is higher correspondingly. Moreover, this drum brake means must be regulated based on the degree of wear on the brake shoe, which is relatively troublesome in maintenance.

SUMMARY OF THE INVENTION

It is the primary object of the present invention to provide an engaging/disengaging fail-safe door closing device for rolling fire door with a simplified structure.

For achieving the aforementioned and other objects, the engaging/disengaging fail-safe door closing device for rolling fire door of the present invention, provided between a power means and a speed reducing means of a door machine, comprises an electromagnet means fixed inside a housing of the door machine and disposed around the outside of a shaft of the power means; a brake means including a shaft sleeve, loosely embracing around the outside of the shaft of the power means and being capable of sliding between this shaft and the electromagnet means, on one end of which, there is provided with an attracted plate facing the magnet means and normally coming off this magnet means under the effect of an elastic element, while on the other end thereof, there is radially formed with a brake disk; a driving plate fixed on the shaft of the power means and facing a position where the brake disk is allowed to contact; and a circuit used to control the electromagnet means in order for actuating the brake when this means is electrified to excite, or releasing the brake when the power is cut off.

In the present invention, when the door machine opens the door to a predetermined location, the electromagnet means is electrified to excite in order to attract the attracted plate in a direction opposed to the elastic element, and meanwhile, slide the shaft sleeve in such a way that the brake disk is pressed against the driving plate for actuating the brake, making the rolling door stay at an upper predetermined location in the opened state. On the contrary, the brake is released if the electromagnet means is not electrified to excite. Thus, in the case of abnormal power failure, the rolling door may be downwardly closed by its own weight no matter what reason therefor is. Then, the rolling door may be closed assuredly without the use of operatively other external power sources or any reserved power source, not only simplifying the structure but also lowering the cost. Moreover, the disadvantage in the conventional drum brake may be further eliminated, because the disk brake without the need for the frequent regulation, performed depending on the degree of wear on the brake linings, is used between the brake disk and the driving plate.

DETAILED DESCRIPTION OF THE INVENTION

Hereinafter, the technical feature of the present invention will be further described by way of one embodiment. It will be understood, however, that the embodiment is merely one preferred example, not used to limit the scope of the present invention thereto, and the present invention will be clearly appreciated from the following detailed description taken in conjunction with the accompany drawings.

Figure 1:
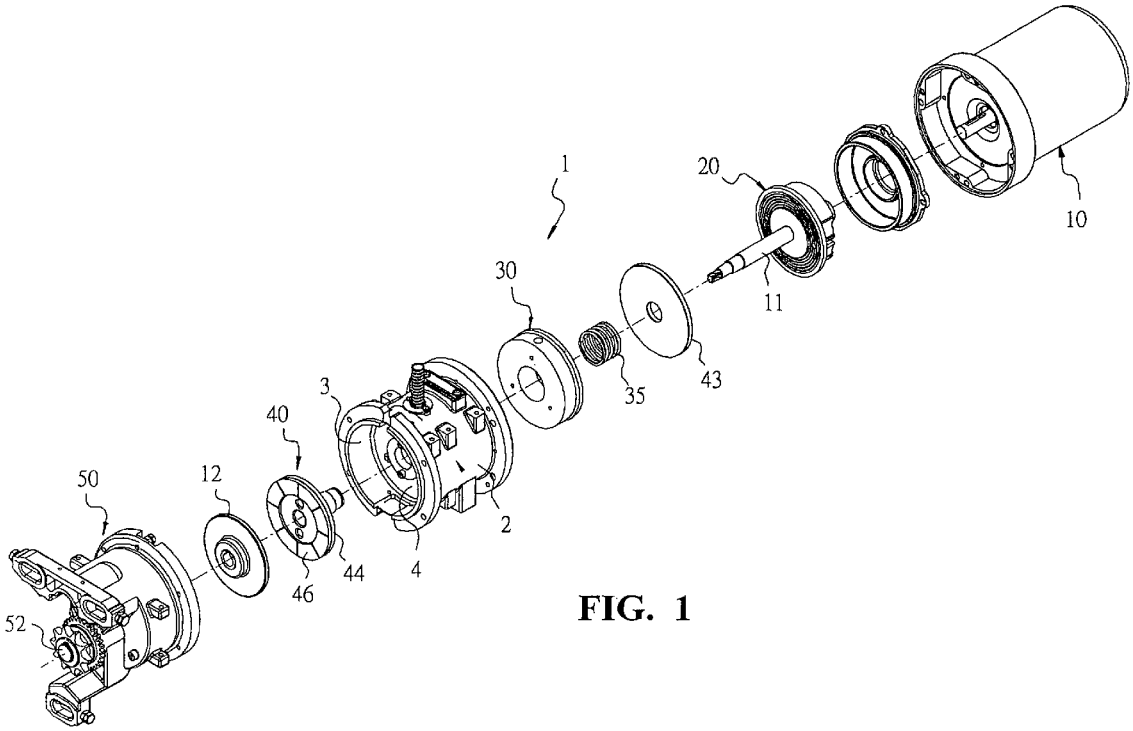
FIG. 1 is an exploded perspective view of a door machine with which the present invention is concerned.
Figure 2:
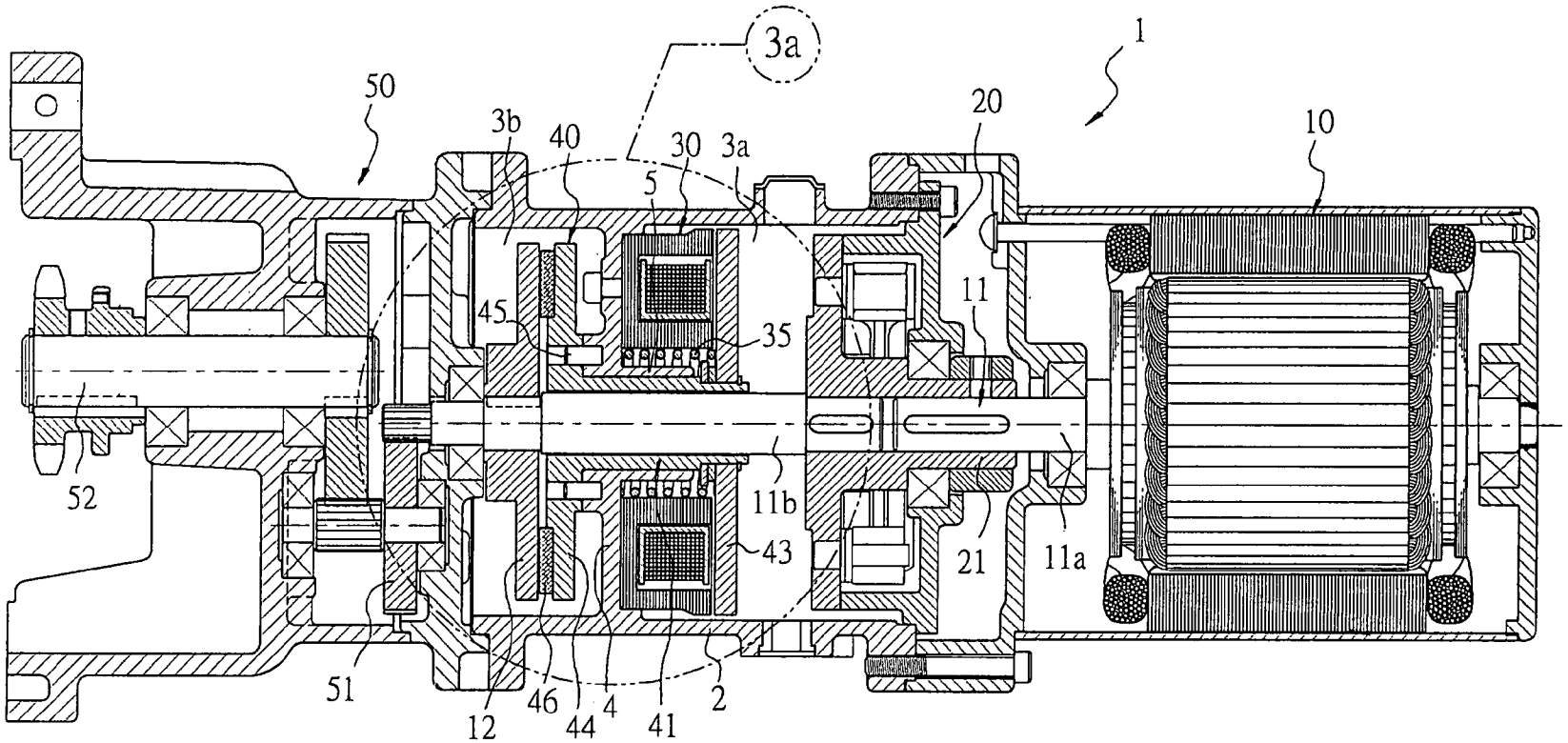
FIG. 2 is a cross-section diagram of the door machine shown in FIG. 1 in an assembled state, where a region encircled by a circle is an engaging/disengaging fail-safe door closing device according to the present invention.

Firstly, referring to FIG. 1 in comparison with FIG. 2, an engaging/disengaging fail-safe door closing device for a rolling fire door is provided between a power means 10 and a speed reducing means 50 of a door machine 1 and used for closing the rolling fire door immediately after a power failure occurs. The door machine 1 mainly comprises: a housing 2 enclosing an accommodation room 3 having two opening ends, the accommodation room 3 being formed therein with a radial partition 4, which divides the accommodation room into a first accommodation room 3*a* and a second accommodation room 3*b*, as well as is extendingly provided with a bearing part 5 toward the first accommodation room 3*a* at the center of the partition 4; a power means 10 coupled to one of the opening ends of the housing 2 and provided with a shaft 11 passing through the center of the bearing part 5 and extending toward the other opening end; a speed reducing means 50 connected to the other opening end of the housing 2 and used to transmit power from the shaft 11 to an output shaft 52 by means of a plurality of gear sets 51.

Figure 3A:
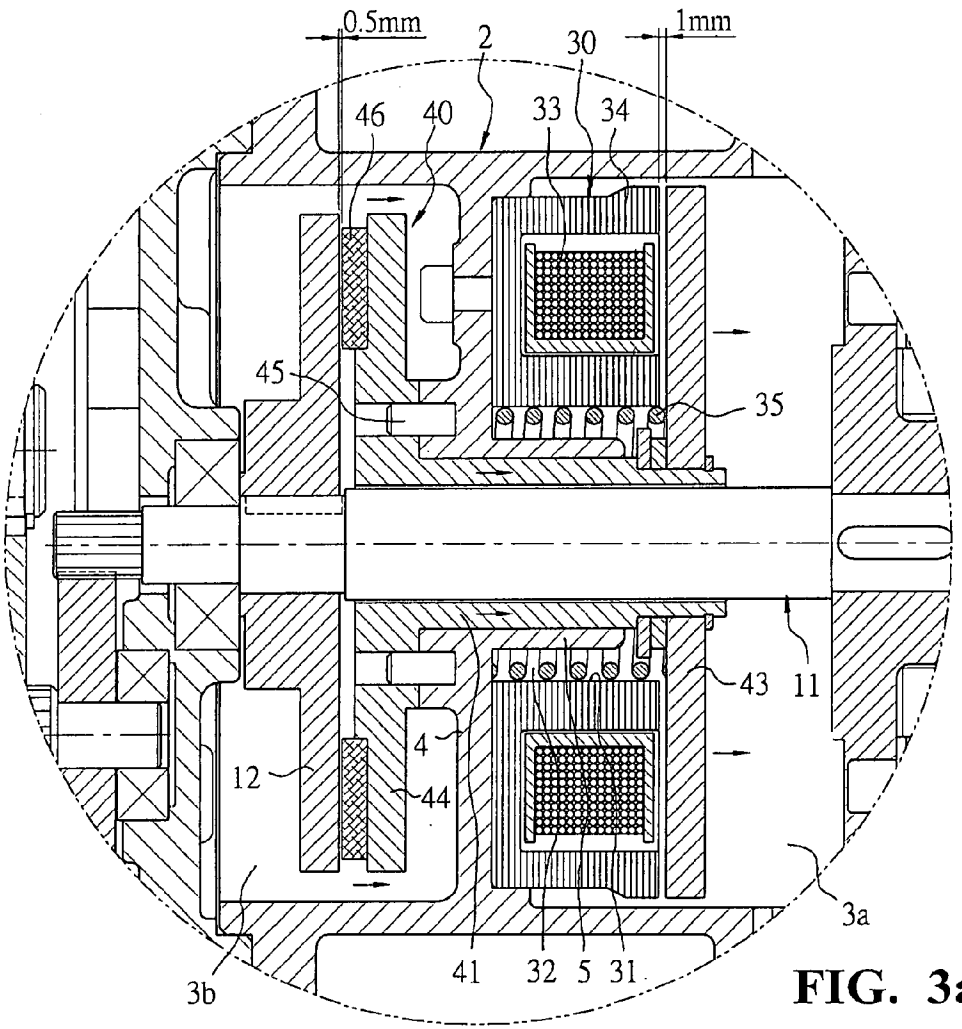
FIG. 3*a* is a partially-enlarged view showing a portion encircled by a circle in FIG. 2, illustrating a brake-released state.

Furthermore, referring to FIG. 3*a*, an electromagnet means 30, composed of a winding 33 and a magnet core 34, is accommodated within the first accommodation room 3*a* and fixed on the partition 4. At the center of the magnet core 34, there is provided with a hollow aperture 31 embracingly provided around the outside of the bearing part 5, and an accommodation space 32 may be remained between this hollow aperture and bearing part. A brake means 40 comprises a shaft sleeve 41 loosely embracing around the outside of the shaft 11 and axially sliding between this shaft and the bearing part 5. On one end of this shaft sleeve, there is fixed with an attracted plate 43 located within the first accommodation room 3*a* and facing the magnet core 34; while on the other end thereof, there is radially formed with a brake disk 44 located within the second accommodation room 3*b*. Moreover, a plurality of locating pins 45 fixed on the partition 4 are used to limit the brake disk 44 to axially slide only without rotating, and numerous brake linings 46 are provided on the end surface of brake disk 44 facing the outside of opening end of the second accommodation room 3*b*. An elastic element 35 is accommodated within the accommodation space 32, and comprises two ends, one of which is rested against the partition 4, while the other is pressed against the attracted plate 43 such that this attracted plate 43 may store energy and then come off the magnetic core 34, remaining an appropriate gap therebetween. A driving plate 12 is accommodated within the second accommodation room 3*b* and fixed at the center thereof on the shaft 11 so as to revolve as this shaft 11 rotates. The driving plate 12 comprises an end surface which faces the brake disk 44 and is normally situated at a non-rested position where the brake lining 46 is allowed to contact, i.e., where the driving plate and the brake lining are not contacted with each other yet. In addition, a circuit 53, as shown in FIG. 3*c*, is used to control the door machine 1 such that the winding 33 of the electromagnet means 30 may be electrified to excite to actuate the brake when the door is opened to a predetermined location, or may release the brake when the power is cut off. The winding 33 of the electromagnet means 30 is serially connected with an UP NC (UP normally closed) and a DN NC (DOWN normally closed) of the power means 10.

Figure 3B:
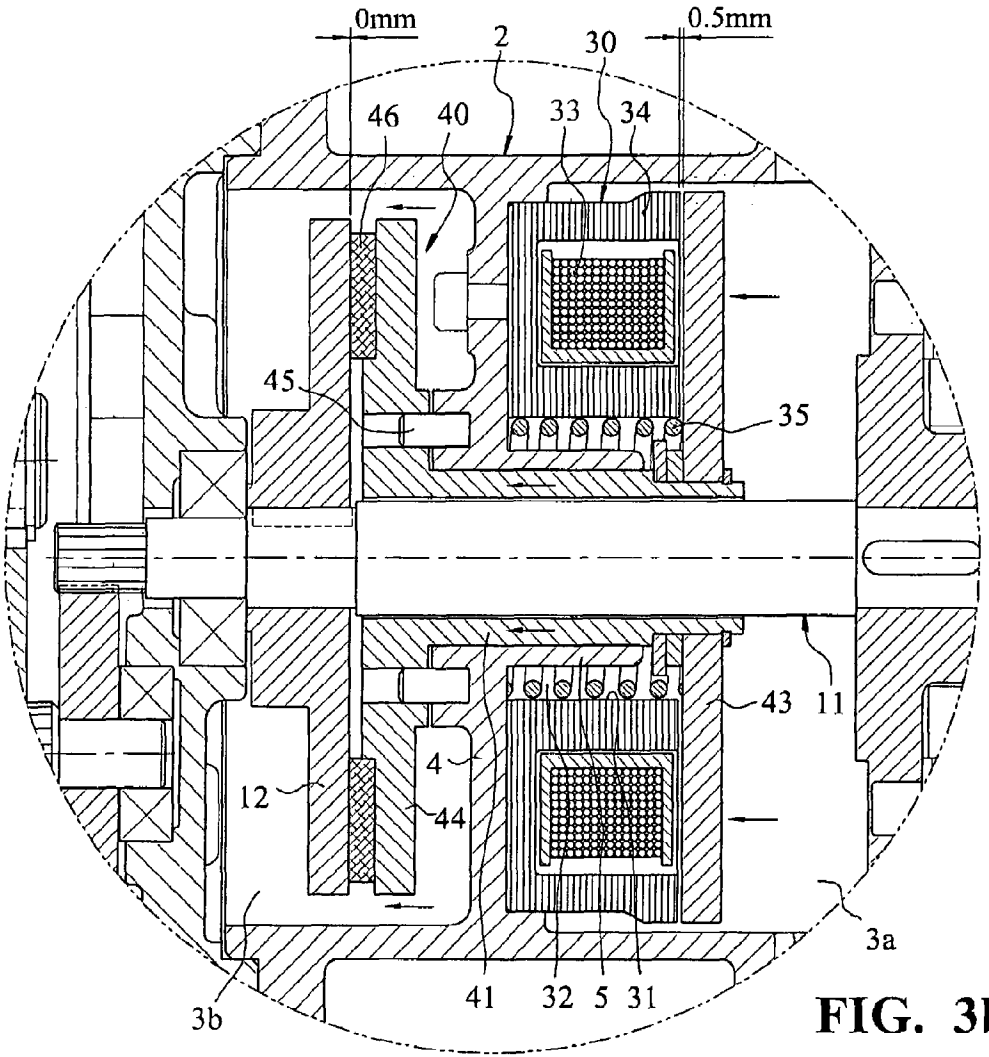
FIG. 3*b* is a partially-enlarged view showing the portion encircled by the circle in FIG. 2, illustrating a braking, balancing state.
Figure 3C:
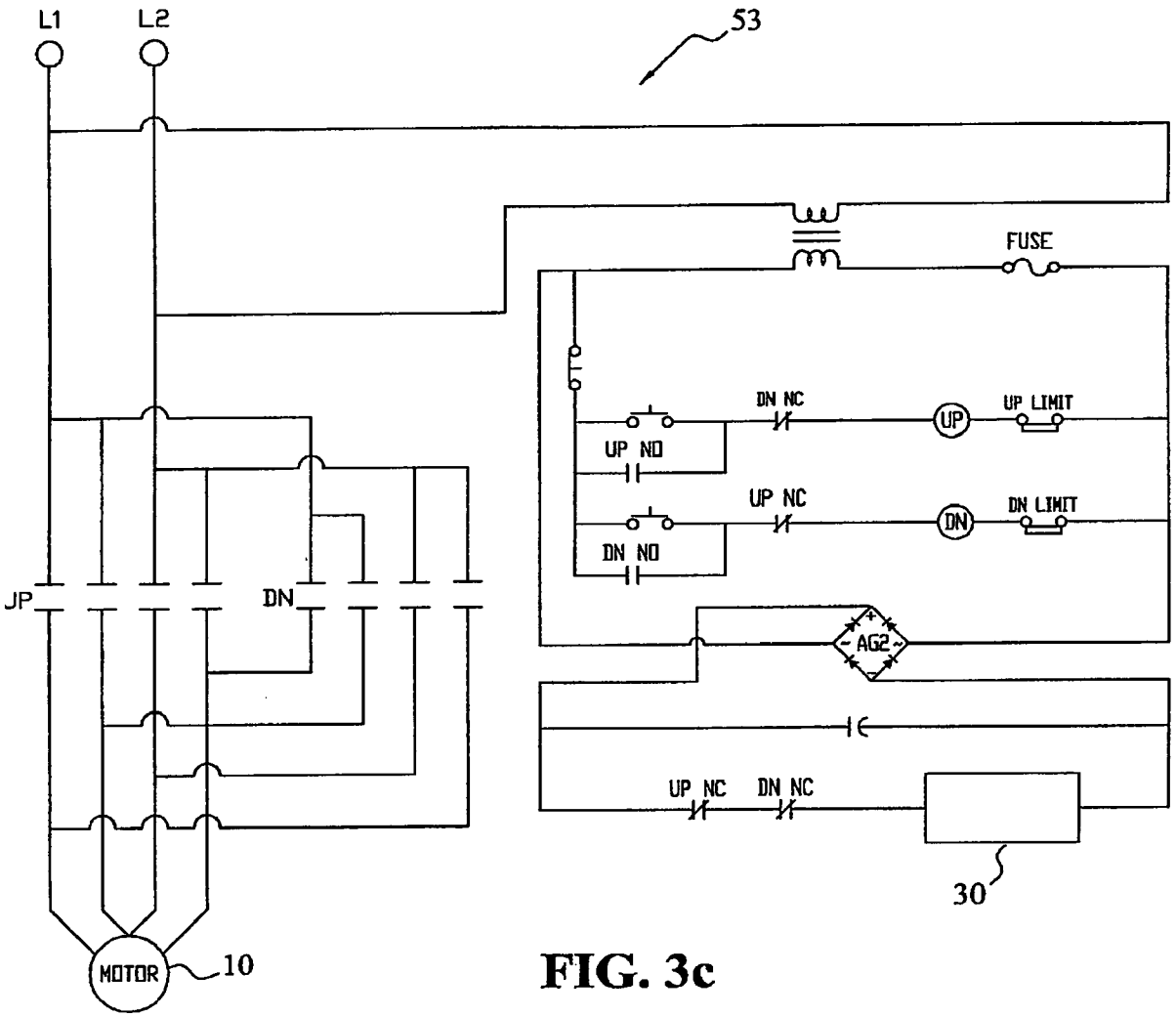
FIG. 3*c* is a diagram showing the control circuit of the door machine according to the present invention.
Figure 5:
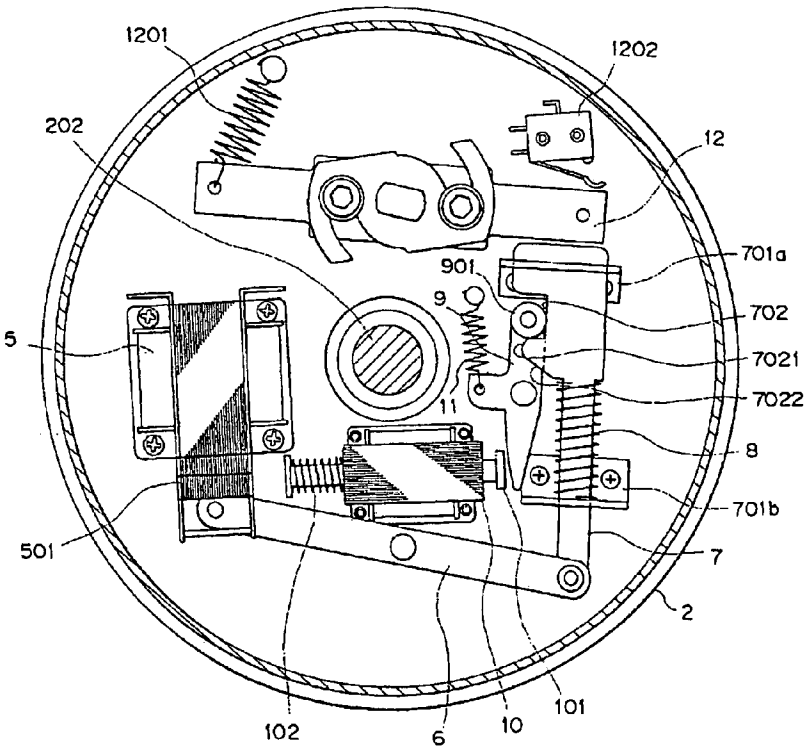
( PRIOR ART ) FIG. 5
FIG. 5 is a diagram of a delayed closing mechanism for rolling fire door, redrawn according to U.S. Pat. No. 5,850, 865 in conventional art.
Figure 4:
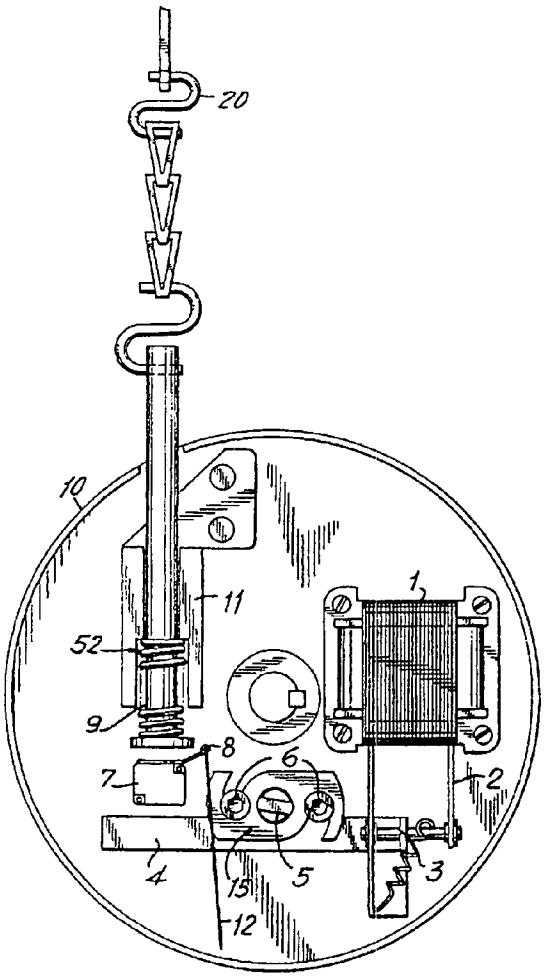
( PRIOR ART ) FIG. 4
FIG. 4 is a diagram redrawn according to U.S. Pat. No. 5,245,879, related to a rolling fire door closing device in conventional art.

When the door machine 1 opens the door to the predetermined location, as shown in FIG. 3*b*, the winding 33 of the electromagnet means 30 is electrified to excite, under the control of the circuit 53, in order to attract and then slide the attracted plate 43 in a direction opposed to the elastic element. Meanwhile, the shaft sleeve 41 may also slide accordingly in the direction toward the driving plate 12, in such a way that the brake lining 46 of the brake disk 44 may press against the driving plate 12 to actuate the brake, making the rolling door stay at an upper predetermined location in the opened state. Furthermore, when the electromagnet means 30 is not electrified, the attracted plate 43 is released, and biased by the elastic element 35 so as to slide away from the magnet core 34, in such a manner that the brake linings 46 of the brake disk 44 may be located at a position, where they are not contacted with the driving plate 12 for releasing the brake (as shown in FIG. 3*a*). As such, in the case of abnormal power failure, the rolling door may be downwardly closed by its own weight no matter what reason therefor is. Then, the rolling door may be closed assuredly without the need for operatively other external power sources or any reserved power source, not only simplifying the structure but also lowering the cost. Moreover, the disadvantage in the conventional drum brake may be further eliminated, because the disk brake without the need for the frequent regulation, performed depending on the degree of wear on the brake linings 46, is used between the brake disk 44 and the driving plate 12.

Furthermore, between the power means 10 and speed reducing means 50 of the door machine 1 in accordance with the present invention, there is further included a centrifugal type stalling protective device 20, provided in the first accommodation room 3*a* (as shown in FIG. 2), used to stop the rolling door by a pair of centrifugal brake means, in case of stalling during the moving of rolling door rolled by the door machine 1. Due to the fact that it is not concerned with the art of the present application, further discussion may be neglected. The centrifugal type stalling protective device 20 comprises at the center thereof an axially extending shaft sleeve 21 by which a first shaft 11*a* and a second shaft 11*b*, constituting the shaft 11 of the power means 10 according to the present invention, are coupled as a unit. Such a design enables individual dismantling and following overhaul with respect to the power means 10 without the need for dismantling the door machine 1 as a whole, in response to a contingent breakdown of door machine 1.

The foregoing description is merely one embodiment of present invention and not considered as restrictive. Namely, all equivalent variations and modifications without in any way departing from the ambit of the invention should be intended to be within the scope of the present invention.

To sum up, the engaging/disengaging fail-safe door closing device for rolling fire door of the present invention is allowed to release the brake and then close the rolling door immediately in the condition of power failure, with the outstanding effects of greater safety for fire prevention, simplified structure, lowered cost, and capability of eliminating the disadvantage in the conventional drum brake, being truly an invention with novelty, advancement or non-obviousness, and availability by the industry.

LIST OF REFERENCE SYMBOLS

1 door machine
2 housing
3 accommodation room
3*a* first accommodation room
3*b* second accommodation room
4 partition
5 bearing part
10 power means
11 shaft
11*a* first shaft
11*b* second shaft
12 driving plate
20 centrifugal type stalling protective device
30 electromagnet means
31 hollow aperture
32 accommodation space
33 winding
34 magnet core
35 elastic element
40 brake means
41 shaft sleeve
43 attracted plate
44 brake disk
45 locating pin
46 brake lining
50 speed reducing means
51 gear set
52 output shaft
53 circuit

The invention claimed is:

1. An engaging/disengaging fail-safe door closing device for a rolling fire door, provided between a power means (10) and a speed reducing means (50) of a door machine (1), used to close said rolling fire door immediately in a condition of power failure, comprising:

an electromagnet means (30) fixed inside a housing (2) of said door machine (1) and disposed around the outside of a shaft (11) of said power means (10);

a brake means (40) including a shaft sleeve (41), loosely embracing around the outside of said shaft (11) of said power means (10) and being capable of sliding between said shaft and said electromagnet means (30), on one end of said shaft sleeve (41) there is provided an attracted plate (43) facing said magnet means (30) and coming off said magnet means (30) by way of the biasing force of an elastic element (35), while on the other end of said shaft sleeve (41) there is radially formed a brake disk (44);

a driving plate (12) fixed on said shaft (11) of said power means (10) and facing a position where said brake disk (44) is allowed to contact; and a circuit (53) used to control said power means (10) so as to actuate the brake when said power means (10) is switched on and said electromagnet means (30) is disconnected or release the brake when said power means (10) is disconnected and said electromagnetic means (30) is switched on.

2. The engaging/disengaging fail-safe door closing device for rolling fire door according to claim 1, wherein an accommodation room (3) is defined by said housing (2) between said power means (10) and said speed reducing means (50) of said door machine (1), said accommodation room (3) being formed therein with a radial partition (4) dividing it into a first accommodation room (3*a*) and a second accommodation room (3*b*), said partition (4) extending toward said first accommodation room (3*a*) and provided at the center thereof with a bearing part (5) supporting around the outside of said shaft sleeve (41).

3. The engaging/disengaging fail-safe door closing device for rolling fire door according to claim 2, wherein said electromagnet means (30) is accommodated within said first accommodation room (3*a*) and fixed on said partition (4), in which a hollow aperture (31) is provided at the center of said electromagnet means and embracingly provided around the outside of said bearing part (5), as well as an accommodation space (32) between said hollow aperture (31) and said bearing part (5).

4. The engaging/disengaging fail-safe door closing device for rolling fire door according to claim 3, wherein said elastic element (35) is accommodated within said accommodation space (32), and comprises two ends, one of which is rested against said partition (4), while the other is pressed against said attracted plate (43).

5. The engaging/disengaging fail-safe door closing device for rolling fire door according to claim 2, wherein said brake disk (44) of said brake means (40) is accommodated within said second accommodation room (3*b*), and limited by a plurality of locating pins (45) to axially slide over said partition (4) only.

6. The engaging/disengaging fail-safe door closing device for rolling fire door according to claim 1, wherein a centrifugal type stalling protective device (20) is further included between said power means (10) and said speed reducing means (50) of said door machine (1) and provided at the center thereof with an axially extending shaft sleeve (21).

7. The engaging/disengaging fail-safe door closing device for rolling fire door according to claim 6, wherein said shaft (11) of said power means (10) comprises a first shaft (11*a*) and a second shaft (11*b*) coupled as a unit by means of said shaft sleeve (21).

8. The engaging/disengaging fail-safe safe door closing device for rolling fire door according to claim 1, wherein a plurality of brake linings (46) are provided on one end surface of said brake disk (44) facing said driving plate (12).

9. A door machine (1), comprising:

a housing (2) enclosing an accommodation room (3) having two opening ends, said accommodation room (3) being formed therein with a radial partition (4), which divides said accommodation room into a first accommodation room (3*a*) and a second accommodation room (3*b*), and provided with a bearing part (5) extending toward said first accommodation room (3*a*) at the center of said partition (4);

a power means (10) coupled to one of said opening ends of said housing (2) and provided with a shaft (11) passing through the center of said bearing part (5) and extending toward the other opening end;

a speed reducing means (50) connected to said the other opening end of said housing (2) and used to transmit power from said shaft (11) to an output shaft (52) by means of a plurality of gear sets (51);

an electromagnet means (30), composed of a winding (33) and a magnet core (34), being accommodated within said first accommodation room (3*a*) and fixed on said partition (4), a hollow aperture (31) at the center of said magnet core (34) being embracingly provided around the outside of said bearing part (5), and an accommodation space (32) remaining between said hollow aperture and said bearing part (5);

a brake means (40) including a shaft sleeve (41) loosely embracing around the outside of said shaft (11) and axially sliding between said shaft and said bearing part (5), on one end of said shaft sleeve, there being fixed with an attracted plate (43) located within said first accommodation room (3*a*) and facing said magnet core (34); while on the other end thereof, there being radially formed with a brake disk (44) located within said second accommodation room (3*b*), as well as a plurality of locating pins (45) fixed on said partition (4) being used to limit said brake disk (44) to axially slide only, and a plurality of brake linings (46) being provided on one end surface of said brake disk (44) facing outward;

an elastic element (35) accommodated within said accommodation space (32) and having two ends, one of which is rested against said partition (4), while the other is pressed against said attracted plate (43);

a driving plate (12) located within said second accommodation room (3*b*) and fixed at the center thereof on said shaft (11), while facing a position where said brake plate (44) and said brake lining (46) are allowed to contact; and a circuit used to control said door machine (1), such that said winding (33) of said electromagnet means (30) is electrified to excite in order for actuating the brake when said door is opened to a predetermined location, or that the brake is released when the power is cut off.

10. The door machine according to claim 9, wherein between said power means (10) and said speed reducing means (50), there is further included a centrifugal type stalling protective device (20) having an axially extending shaft sleeve (21) at the center thereof.

11. The door machine according to claim 10, wherein said shaft (11) of said power means (10) comprises a first shaft (11*a*) and a second shaft (11*b*) coupled as a unit by means of said shaft sleeve (21).

* * * * *